US005382189A

United States Patent [19]

Arendall

[11] Patent Number: 5,382,189

[45] Date of Patent: Jan. 17, 1995

[54] HAND HELD ABRASIVE DISK

[76] Inventor: William L. Arendall, 757 Hill Rd., Brentwood, Tenn. 37027

[21] Appl. No.: 14,499

[22] Filed: Mar. 17, 1993

Related U.S. Application Data

[63] Continuation of Ser. No. 843,306, Feb. 27, 1992, abandoned, which is a continuation of Ser. No. 614,287, Nov. 16, 1990, abandoned.

[51] Int. Cl.[6] ..... B24D 15/00

[52] U.S. Cl. ..... 451/557; 451/552; 451/319

[58] Field of Search ..... 51/209 R, 205 R, 204, 51/211 R, 149, 156, 391, 392, 393

[56] References Cited

U.S. PATENT DOCUMENTS

| | | | |
|---|---|---|---|
| 1,059,566 | 4/1913 | Rodgers | 51/211 R |
| 1,896,946 | 2/1933 | Gauss | 51/205 R |
| 1,924,502 | 8/1933 | Kincaid | 51/205 R |
| 2,120,483 | 6/1938 | Burger | 51/205 R |
| 2,723,515 | 11/1955 | Stuck | 51/205 R |
| 3,229,425 | 1/1966 | Homeyer | 51/211 R |

FOREIGN PATENT DOCUMENTS

| | | | |
|---|---|---|---|
| 589725 | 12/1959 | Canada | 51/205 R |
| 415201 | 9/1910 | France | 51/204 |

*Primary Examiner*—Bruce M. Kisliuk
*Assistant Examiner*—Eileen P. Morgan
*Attorney, Agent, or Firm*—I. C. Waddey, Jr.

[57] ABSTRACT

A hand held abrasive disk for deburring, honing, finishing and polishing, or sharpening a material that can be easily held in one's hand. The abrasive surface has a concave section for receiving the filings from the abraded material. A cap is releasably attached to the non-abrading surface to prevent irritation of the user's hand and to prevent damage to the surface upon which the stone is set.

2 Claims, 2 Drawing Sheets

HAND HELD ABRASIVE DISK

This is a continuation of application Ser. No. 843,306 filed on Feb. 27, 1992, now abandoned which was, in turn, a continuation of application Ser. No. 614,287, filed Nov. 16, 1990 now abandoned.

Be it known that I, William L. Arendall, a citizen of the United States, residing at 757 Hill Road, Brentwood, Tenn. 87027, have invented a new and useful "Hand Held Abrasive Disk".

BACKGROUND OF THE INVENTION

This invention relates generally to a stone for such uses as deburring, honing, lapping and polishing, and razor-sharpening, and more particularly to an abrasive disk which is particularly adapted for use by hand and which has a removable cap.

It will be appreciated by those skilled in the art that abrasive stones are used for a variety of deburring, honing, finishing and polishing, and sharpening operations. At times, someone desiring to perform such tasks desires to do so with a different pattern or with a more comfortable device than what is provided by the abrading tools or stones which presently exist. To this end, there have been several attempts to provide such devices.

Several such attempts involve the use of an abrading device attached to a power tool. The power tool then provides for movement of the abrading device. One such abrading device is disclosed in U.S. Pat. No. 4,689,922, issued to Blanchard, Jr., which teaches a buffing pad that attaches to the shaft of a power tool. Another example is found in U.S. Pat. No. 4,754,577, issued to J. H. MacKay, Jr., for a disposable finishing article having an integral mounting hub, including improved pressure cap. This, too, attaches to the shaft of a power tool. Other examples of this type are U.S. Pat. No. 4,878,316; 4,896,463; and 4,945,687. However, none of these devices can be hand held to provide a non-rotary type abrading. Also, these rotary-type implements tend to move at such high speeds that they cannot be used for precision operations. Because of their shape, the filings from the abraded material tend to decrease the efficiency of the abrading. Because of the materials used, the porosity is such that some type of oil or other lubricant must be used for abrading.

U.S. Pat. No. 4,202,139, issued to I. S. Hong et al., discloses a conformable hand sanding pad. This patent exemplifies the state of the hand held abrading devices. Presently, the art focuses upon a hand held sanding device as opposed to a hand held abrading stone. The Hong et al. patent is shaped such that the abraded material can actually interfere with the sanding properties of the pad. The Hong device uses a finger loop for attachment to the hand that can be very uncomfortable to the user.

Finally, conventional sharpening stones and the like are useful but have significant drawbacks. The shape is uncomfortable to grip and difficult to use on certain shaped surfaces. The shape of the stone can also interfere with its own abrading properties.

What is needed, then, is a hand held abrasive disk shaped to be comfortable in the user's hand, as well as to prevent the filings from the abraded object to interfere with the abrading properties of the disk. This disk must have some type of protection for the user's hand to prevent direct exposure to the abrasive disk and to protect sensitive surfaces to which the disk may come in contact when not in use. This hand held abrasive disk must have sufficient porosity to allow water to be used as a lubricant without the requirement of oil. The abrading disk must be long lasting. The abrasive disk must be simple and usable independent of the availability of electric power. This hand held abrading device must have two sides that can be used for abrading so that if one side is unusable because of wear, the other side can be used. This abrasive disk is lacking in the prior art.

SUMMARY OF THE INVENTION

In the present device, a hand held stone is formed in a general disk shape having an upper surface and a lower surface. Between the upper and lower surfaces is an arcuately placed groove for placement of the user's fingers. A cap is releasably attached to the upper surface of the stone to provide more comfortable use and to protect delicate surfaces. A concave section can be placed centrally in the lower surface, so that when the disk is used the filings from the abraded material will either fall away from the stone or be collected within the concave section, to prevent the filings from interfering with the disk's effectiveness. If a flat surfaced disk is required, the cap can be placed over the lower side and the upper side can be used for abrading of the disk can be manufactured with fully planar upper and lower surfaces.

Accordingly, an object of the present invention is to provide a hand held abrasive disk of superior performance and sharpening capabilities.

Still another object of the present invention is to provide a disk that is long lasting.

Another object of the present invention is to provide a stone of sufficient micro-porosity to enable water to be used for self-lubrication, thereby removing the need to use oils or kerosene for lubrication.

Another object of the present invention is to provide a cap to prevent hand irritation, as well as to prevent damage to the surface upon which the disk is placed.

A further object of the present invention is to provide an ergonomically correct stone that allows firm and non-slip grip of the stone in tight spaces and on a variety of materials.

Still a further object of the present invention is to provide a concave section in which filings from the abraded material can flow, thereby preventing the filings from interfering with the abrasive properties of the stone.

Still a further object of the present invention is to provide two-sided stone which allows a second side to be used when a different surface is required or where one side wears out while providing a removable cap for comfortable use and protection of sensitive surfaces.

Still another object of the present invention is to provide a stone that can be used in the absence of electric power.

Another object of the present invention is to provide a disk that will extend the life span of the abraded tools.

DESCRIPTION OF THE PREFERRED EMBODIMENT

Figure 1:
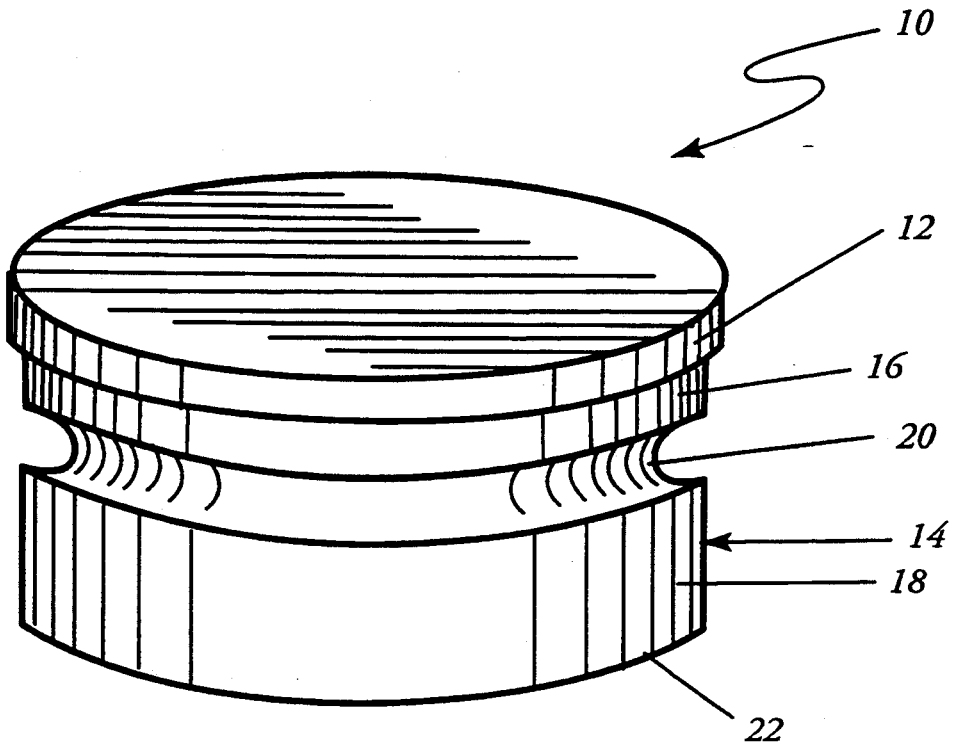
FIG. 1 is a perspective top view of the hand held abrasive disk and cap of the present invention.
Figure 2:
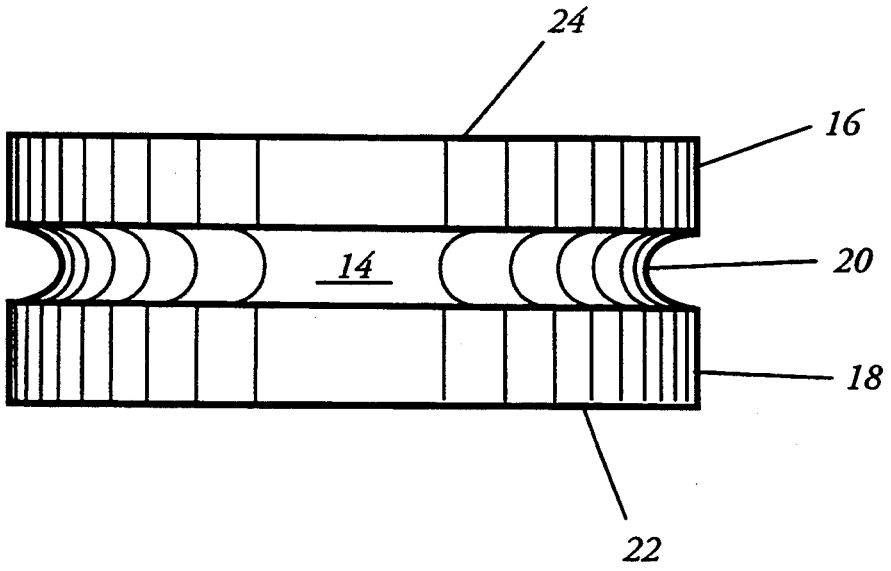
FIG. 2 is a side view of the hand held abrasive disk.

Referring now to FIG. 1, there is shown generally at 10 the hand held abrasive disk of the present invention. Disk 10 includes a stone 14 having a lower surface 22 and upper surface (24 in FIG. 2). Cap 12 is placed over upper surface 24. Stone 14 has top lip 16 proximate to upper surface 24 and bottom lip 18 proximate to lower surface 22. Groove 20 is arcuately placed around stone 10 between top lip 16 and bottom lip 18. Groove 20 is intended to provide a comfortable resting place for the user's fingers. Cap 12 is intended to provide a surface to reduce the irritation to a user's hand, as well as to provide a surface upon which disk can be placed to avoid damage to the surface upon which it is set.

Figure 3:
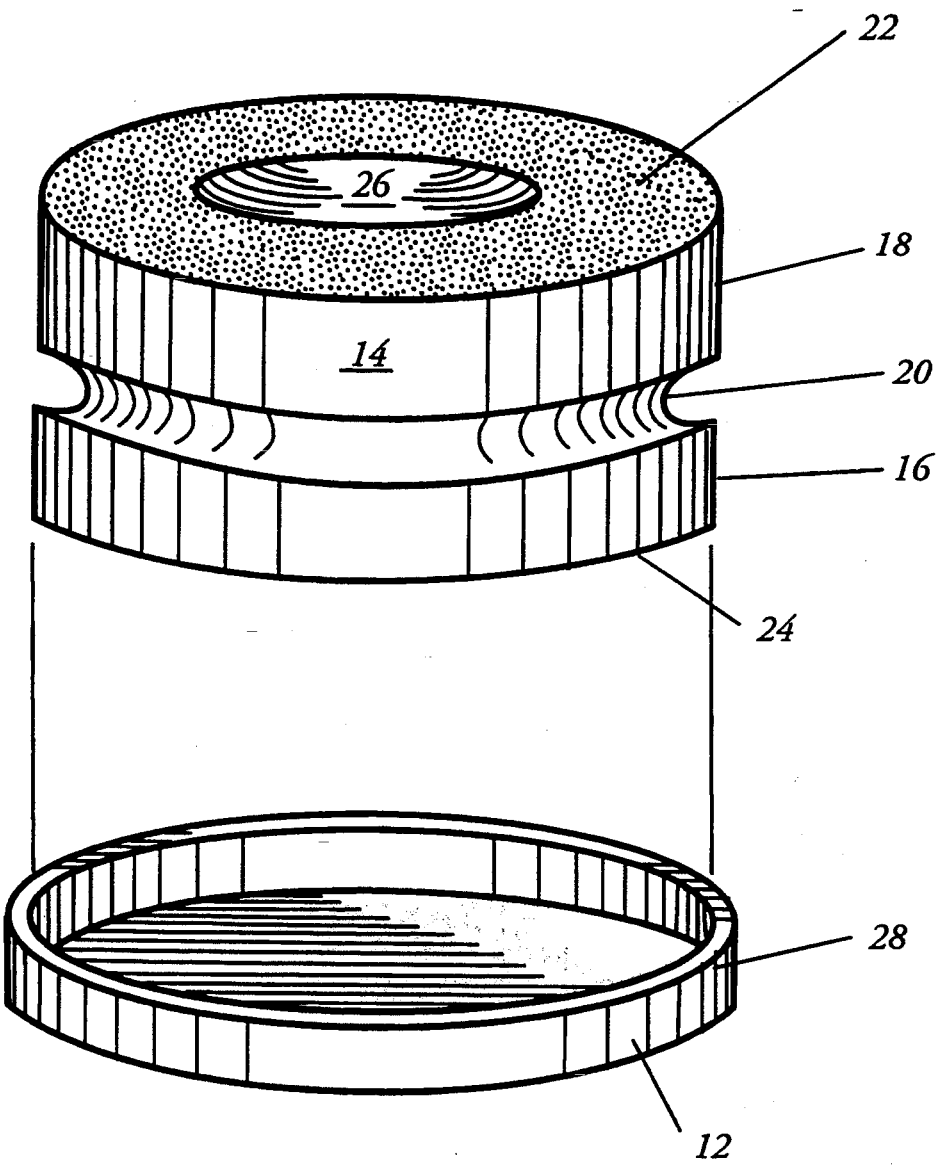
FIG. 3 is a perspective exploded view of the lower side of the hand held abrasive disk.

FIG. 3 generally shows the placement of cap 12 upon stone 14 at top lip 16 to cover upper surface 24. Rim 28 of cap 12 frictionally and releasably attaches to top lip 16. Concave section 26 is provided on lower surface 22 to provide a repository in which filings from the abraded material can fall to prevent the filings from interfering with the abrasive properties of lower surface 22. If two abrading surfaces are required, concave section 26 can be placed on both surfaces 22, 24 or in an alternative embodiment, eliminated entirely.

Generally, disk 10 can be used for deburring rough surfaces, edges, and high spots on all metals, plastics, and wood, as well as for removing rust and scale quickly, in cleaning and resurfacing or touching up tools, parts, surfaces, fabrications, welds, and machines. Disk 10 can be used for honing precision edge tools and instruments, and finely finishing tools, dies, molds, jigs, and fixtures. Disk 10 can be used for lapping and polishing delicate surfaces, parts, and instruments to close tolerances and accuracies, and the finest required micron surface finishes, where required. Disk 10 can be used for razor sharpening knives, cutlery, blades, farm tools, garden tools, lawn and landscaping tools, and construction and hand tools, and for restoring ultra-fine, exceptionally keen, long lasting cutting edges and precision smooth finishes.

In the preferred embodiment, lower surface 22 and upper surface 24 are generally a flat plane. The diameter of stone 14 at top lip 16 and bottom lip 18 is substantially 3 11/16 inches, in the preferred embodiment, although any size disk can be used. In the preferred embodiment, top lip 16 has a thickness from upper surface 24 to beginning of groove 20 of 0 to substantially $\frac{3}{8}$ inches. Groove 20 has a thickness between top lip 16 and bottom lip 18 of substantially 11/16 inches, and a depth of 0 to substantially 7/32 inches. Bottom lip 18, in the preferred embodiment, has a thickness from lower surface 22 to beginning of groove 20 of 0 to substantially 11/16 inches. Concave section 26 has a diameter of between 0 to substantially 1 15/16 inches, and depth of between 0 to 13/16 inches. The product weight in the preferred embodiment is less than 1000 grams.

Cap 12 is removable and interchangeable and made of plastic-vinyl in the preferred embodiment. This allows one to imprint any name, logo, trademark, picture, depiction, figure, animal, or any other drawing which would help market or sell the product to an array of corporate or individual customers.

Stone 14 is made from a combination of the following materials: aluminum oxide of any color or grit size, corundum, alumina, emery, silicon carbide of any color and grit size, ceramic aluminum oxide of any grit size, cubic boron nitride of any grit size, zirconium or zirconia, or any other sharpening, grinding, honing, polishing, finishing, deburring, or other, abrasive or other media. This raw material can be bonded using any of the following materials: vitrified, resinold or resin; organic or resin; plastic; shellac; rubber; silicate; or metal.

Cap 12 is sized such that rim 28 fits around top lip 16. Cap 20 can be made of plastic, vinyl, leather, leatherette, or any other water resistant, oil resistant, moldable or formable material.

Thus, although there have been described particular embodiments of the present invention of a new and useful hand held abrasive disk, it is not intended that such references be construed as limitations upon the scope of this invention, except as set forth in the following claims. Further, although there have been described certain dimensions used in the preferred embodiment, it is not intended that such dimensions be construed as limitations upon the scope of this invention, except as set forth in the following claims.

What I claim is:

1. A hand held abrasive disk for use on a work piece comprising:
   a. a stone having a lower surface and an upper surface, a top lip, and a bottom lip, and a finger groove arcuately formed between said top lip and said bottom lip;
   b. said stone having a top shape formed by the upper surface and the top lip and a bottom shape formed by the lower surface and the bottom lip;
   c. a hollow flexible cap having an inner cross-sectional shape, the inner cross-sectional shape of the hollow portion of the cap being of a size to allow the inside wall of the hollow portion of the cap to be slid over and into engagement with a lip of the stone;
   d. said cap having a shape conforming to both the shape of the top and the shape of the bottom of the stone; and
   e. said cap further comprising a formable or moldable material adapted for protecting a user's hand and for receiving imprinted information.

2. A hand held disk for abrading a work piece, comprising:
   a. a stone having a lower surface and an upper surface, a top lip, and a bottom lip;
   b. a flexible cap having a rim releasably attached to either said top lip or said bottom lip of said stone to prevent irritation of a user's hand by said stone; and
   c. wherein said cap is hollow and the inner diameter of the hollow portion of the cap is of a size which allows an inside circumferential wall of the hollow portion of the cap to be slid over and into engagement with a circumferential lip of the stone.

* * * * *